US005778838A

United States Patent [19]

Taue

[11] Patent Number: 5,778,838

[45] Date of Patent: Jul. 14, 1998

[54] FUEL SUPPLY DEVICE FOR CRANKCASE CHAMBER SUPERCHARGED ENGINE

[75] Inventor: Jun Taue, Iwata, Japan

[73] Assignee: Yamaha Hatsudoki Kabushiki Kaisha, Iwata, Japan

[21] Appl. No.: 832,421

[22] Filed: Apr. 2, 1997

Related U.S. Application Data

[62] Division of Ser. No. 563,920, Nov. 29, 1995, Pat. No. 5,678,525.

[51] Int. Cl.[6] ..... F02B 33/04

[52] U.S. Cl. ..... 123/73 B; 123/73 PP; 123/65 VD; 123/318

[58] Field of Search ..... 123/73 PP, 73 A, 123/65 VB, 73 C, 73 B, 317, 318, 65 VD

[56] References Cited

U.S. PATENT DOCUMENTS

| | | | |
|---|---|---|---|
| Re. 22,863 | 4/1947 | Mallory . | |
| Re. 22,883 | 4/1947 | Mallory | 123/73 B |
| Re. 27,367 | 5/1972 | Von Seggern et al. | 123/73 B |
| 924,483 | 8/1909 | Manuel | 123/73 B |
| 1,019,563 | 3/1912 | Ulrich | 123/73 B |
| 3,973,532 | 8/1976 | Litz | 184/6.5 |
| 4,075,885 | 2/1978 | Iwai | 123/73 B |
| 4,075,985 | 2/1978 | Iwai | 123/73 A |
| 4,088,097 | 5/1978 | Litz . | |
| 4,920,933 | 5/1990 | Iwai et al. | 123/73 A |
| 4,944,255 | 7/1990 | Duret | 123/73 PP |
| 5,072,699 | 12/1991 | Pien | 123/65 VC |
| 5,090,363 | 2/1992 | Duret | 123/73 PP |
| 5,138,984 | 8/1992 | Takashima | 123/73 A |
| 5,279,269 | 1/1994 | Aizawa et al. | 123/317 |
| 5,291,866 | 3/1994 | Kosa | 123/317 |
| 5,377,634 | 1/1995 | Taue | 123/317 |
| 5,419,289 | 5/1995 | Duret et al. | 123/73 B |
| 5,462,024 | 10/1995 | Nuti | 123/73 A |
| 5,503,119 | 4/1996 | Glover | 123/73 B |

FOREIGN PATENT DOCUMENTS 0631040 12/1994 European Pat. Off. .

OTHER PUBLICATIONS

European Search Report dated Apr. 19, 1996.

*Primary Examiner*—David A. Okonsky
*Attorney, Agent, or Firm*—Knobbe, Martens, Olson & Bear LLP

[57] ABSTRACT

A four-cycle internal combustion engine wherein the piston connecting rod crankshaft and crankcase chamber are formed so that the crankcase chamber acts as compressor. An induction system supplies atmospheric air to the crankcase chamber and a pressure conduit supplies air from the crankcase chamber to the engine intake valve. A plenum chamber is disposed within this pressure conduit and pressure control is possible by bypassing air form the plenum chamber to the atmospheric air inlet. A throttle valve is positioned downstream of the plenum chamber so as to improve engine braking and charge forming systems are disclosed that permit a compact assembly and good response under all engine running conditions.

30 Claims, 6 Drawing Sheets

FUEL SUPPLY DEVICE FOR CRANKCASE CHAMBER SUPERCHARGED ENGINE

CROSS REFERENCE TO RELATED APPLICATION

This Application is a division of my Application of the same title, Ser. No. 08/563,920 filed Nov. 29, 1995, now U.S. Pat. No. 5,678,525 and assigned to the assignee hereof.

BACKGROUND OF THE INVENTION

This invention relates to a crankcase chamber supercharged engine and more particularly to an improved induction and fuel supply system for such engines.

As is well known, in addition to providing a variable volume combustion chamber above the piston, the area below the piston in a reciprocating engine also can function as compressor. With two-cycle engines this is frequently the case and such engines are called two-cycle, crankcase compression engines when the change in volume in the crankcase chamber is employed as a means for pumping air to the combustion chamber.

Arrangements have also been proposed wherein the crankcase chamber of a four-cycle engine is employed as an air pump. With four-cycle engines, an actual boost in pressure can be achieved because combustion occurs only every other crankcase revolution. Hence, there can be two pumping phases a given combustion phase and increases in pressure are possible.

However, the efficiency of such crankcase compressors depends upon maintaining a very small clearance volume therein. Therefore, there has been proposed as shown in my Letters U.S. Pat. No. 5,377,634, entitled "Compressor System For Reciprocating Machine," issued Jan. 3, 1995 and assigned to the assignee hereof, an arrangement wherein the crankcase volume is maintained relatively small and the piston, connecting rod and crankshaft cooperate with the crankcase chamber so as to provide a compressor. This is a very effective way of increasing engine output.

However, there still remains the problem of supplying a fuel charge to the engine. Where the crankcase is used as a compressor, it is desirable to provide a plenum chamber on the outlet side of the crankcase chamber between the crankcase chamber and the intake valve of the engine. The plenum chamber is useful in storing the increased pressure until the intake valve opens and reducing pressure fluctuations. However, if the charge former or carburetor is placed on this side, then the placement of the components and the provision of a large enough plenum chamber can present problems.

It is, therefore, a principal object of this invention to provide an improved crankcase compression type of internal combustion engine wherein the charge forming and induction system permits high efficiencies and also can be compact in construction.

It is a further objection of this invention to provide an improved induction and charge forming system for crankcase compression engines wherein a plenum volume can be provided on the discharge end and the charge former can be located in such a manner as to not reduce the volume of the plenum chamber.

Certain advantages can be achieved by placing the charge former on the inlet side of the engine. In this way, the air charge which is delivered to the crankcase chamber for compression also includes fuel. The advantage of this is that it will ensure that the fuel becomes vaporized before delivered to the combustion chamber. In addition, the partial vaporization of the fuel in the crankcase chamber provides a cooling effect which assists in reducing the heat load on the engine and improves its efficiency.

It is, therefore, a still further object of this invention to provide an improved charge forming system for a crankcase compression engine wherein the charge former is positioned upstream of the crankcase compression chamber.

When the charge former is placed on the upstream side of the crankcase chamber, then another problem may result. That is, it is conventional to control speed of the engine by employing a throttle valve and, when carburetors are employed as the charge former, this throttle valve forms a portion of the charge former. However, if the charge former is placed on the upstream side of the crankcase chamber, then engine braking can be significantly reduced.

That is, when the operator desires to reduce the speed of the load driven by the engine and closes the throttle valve, instant engine braking cannot be achieved because of the fact that the throttle valve is separated from the combustion chamber by the plenum chamber. The plenum chamber performs its function of damping pressure and, as a result, engine braking can be reduced with such an arrangement.

It is, therefore, a still further object of this invention to provide an improved induction and charge forming system for a crankcase compression internal combustion engine wherein the engine braking can be achieved while maintaining the aforenoted advantages.

It is a further object of this invention to provide an improved throttle valve arrangement for the crankcase compression engine wherein the throttle valve is positioned apart from the charge forming system so as to facilitate engine braking without losing the aforenoted advantages.

Another disadvantage with positioning the charge forming system for engines of this type on the inlet side to the crankcase chamber is that control under transient conditions can somewhat deteriorate. That is, many times the operator wishes to change the engine performance by increasing the power output. When the charge former is disposed downstream of the crankcase chamber it will be some time before the called for demand in increased fuel supply will actually reach the combustion chamber. Hence, there may be some lag in engine performance.

It is, therefore, a still further object of this invention to provide an improved induction system for a crankcase impression internal combustion engine wherein the charge former provides good transient response.

SUMMARY OF THE INVENTION

This invention is adapted to be embodied in an internal combustion engine that is comprised of a cylinder block, cylinder head assembly defining a cylinder bore. A piston reciprocates in the cylinder bore and forms a combustion chamber at one end of the cylinder bore. A crankcase chamber is formed at the other end of the cylinder bore and contains a rotatably journaled crankshaft. The crankshaft, a connecting rod which connects the piston to the crankshaft, the piston and the crankcase chamber are formed so that the crankcase chamber functions as a compression as the piston reciprocates in the cylinder bore. The crankcase chamber also functions as a portion of an induction system for delivering atmosphere under pressure to the combustion chamber. The induction system includes, in addition to the crankcase chamber, an atmospheric air inlet for supplying atmosphere air to the crankcase chamber and a pressurized air conduit for communicating the compressed air to the combustion chamber. A manually operated throttle valve is positioned in the air conduit for controlling the flow therethrough. A charge former, which is formed independently of the throttle valve, supplies fuel to the combustion chamber.

DETAILED DESCRIPTION OF THE PREFERRED EMBODIMENTS OF THE INVENTION

Figure 1:
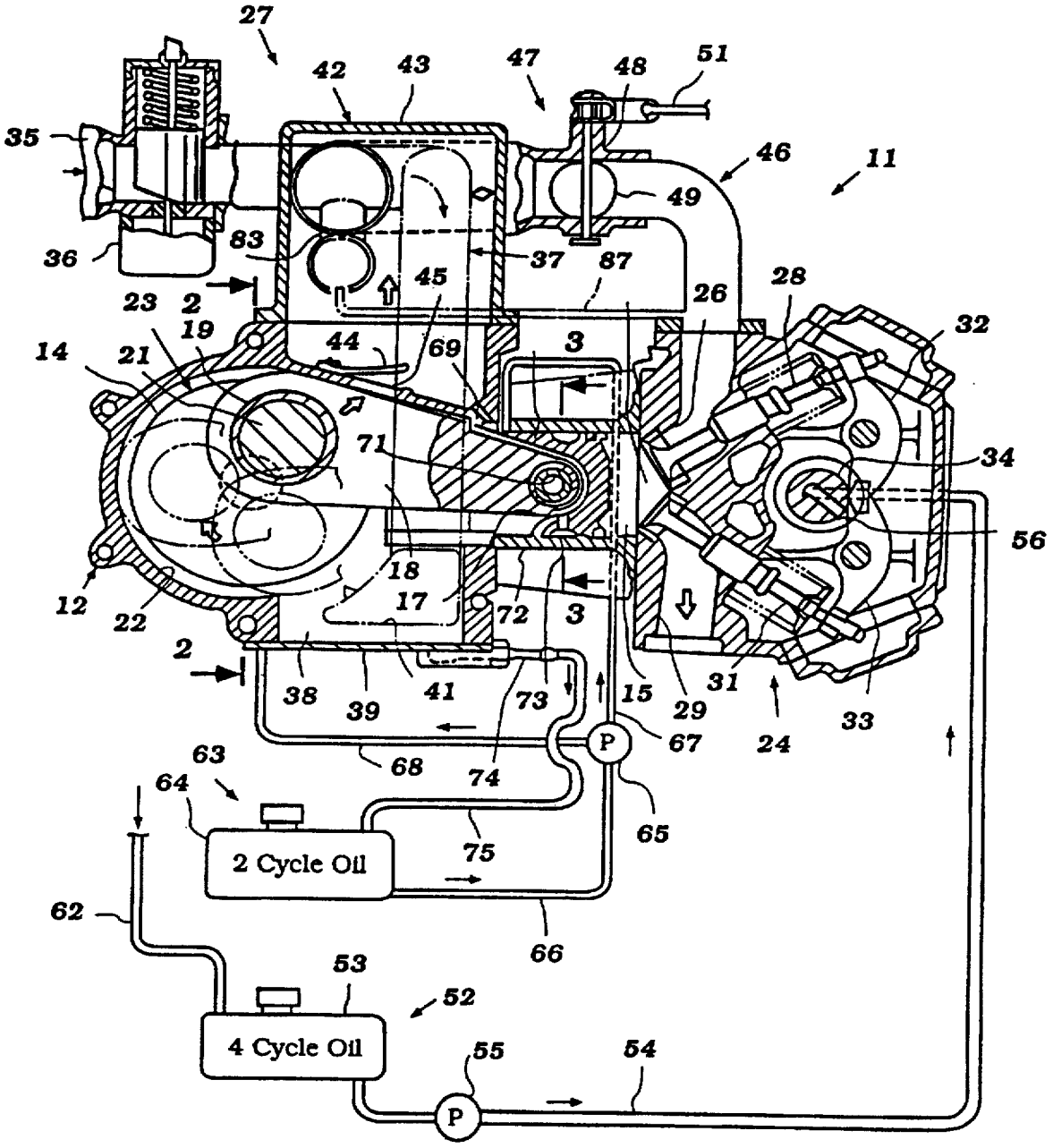
FIG. 1 is a partially schematic cross-sectional view taken through one cylinder of an internal combustion engine constructed in accordance with an embodiment of the invention.

Referring now in detail to the drawings and initially to FIG. 1 a four cycle internal combustion engine constructed in accordance with an embodiment of the invention is identified generally by the reference numeral 11. The engine 11 may be of any known configuration such as an in-line engine, a V-type engine or an opposed engine and may have any number of cylinders. Since the invention may be employed with multiple cylinder engines having any of these types of configurations, only a single cylinder of the engine 11 has been illustrated.

Also, although the invention is described in conjunction with a four cycle internal combustion engine, it is to be understood that facets of the invention may be employed with engines operating on other principles such as two stroke engines.

The engine 11 is provided with a cylinder block crankcase assembly, indicated generally by the reference numeral 12 and composed of a cylinder block 13 and a crankcase member 14 that are fixed to each other in any suitable manner or which may be formed as a unitary assembly if desired. The cylinder block 13 is provided with one or more cylinder bores 15 in which pistons 16 reciprocate and which extend horizontally as shown in the drawings. Each piston 16 is pivotally connected by means of a piston pin 17 to the small end of a connecting rod 18.

The big end of the connecting rod 18 is journaled on the throw or crank pin 19 of a crankshaft, indicated generally by the reference numeral 21 which is rotatably journaled within a crankcase chamber 22 which, in turn, is formed in the crankcase member 23. If the engine 11 is of a multi-cylinder type, each crankcase chamber 22 will be preferably sealed from the others.

A cylinder head assembly, indicated generally by the reference numeral 24 is affixed to the cylinder block 13 in any well known manner. The cylinder head 24 has a recess 25 formed in its lower surface which recess align with the cylinder bore 15 and the head of the piston 16 to form the individual combustion chambers of the engine 11. The recesses 25 will, at times, be referred to as the combustion chambers since at top dead center (TDC) their volume comprises the major portion of the clearance volume.

An intake passage 26 extends through one side of the cylinder head 24 and is served by an induction and charge forming system, indicated generally by the reference numeral 27 and which will be described in more detail later. The intake passage 26 terminates at its inner side at a valve seat which is controlled by an intake valve 28.

In a similar manner, an exhaust passage 29 extends through the opposite side of the cylinder head 24 and terminates in a valve seat that is controlled by an exhaust valve 31. In the illustrated embodiment, the intake and exhaust valves, 28 and 31 respectively, are operated by respective rocker arms 32 and 33 which, in turn, are controlled by a single overhead camshaft 34 that is journaled for rotation in the cylinder head 24 in a known manner. The camshaft 34 is driven from the crankshaft 21 by a drive mechanism at one half crankshaft speed, as is well known in this art.

The valve springs keeper mechanisms etc. associated with the intake and exhaust valves 28 and 31 may be of any conventional construction and those skilled in the art will readily understand the valve actuation and how this can be accomplished.

An important feature of this invention is the way in which the crankcase chamber 22, connecting rod 18 and crankshaft 21 are configured so as to cooperate with the piston 16 and act as a positive displacement air compressor or supercharger supplying a pressurized air/fuel mixture to the combustion chamber 25. To this end, the construction of the cylinder block crankcase assembly 22, crankshaft 21, connecting rods 18 and piston 16 which permits this positive displacement compressor is constructed in accordance with the manner described in Letters U.S. Pat. No. 5,377,634, entitled "Compressor System For Reciprocating Machine," issued Jan. 3, 1995 and assigned to the assignee hereof. That disclosure is incorporated herein by reference. In this system the air/fuel mixture is drawn into the induction system 27 through an atmospheric air inlet 35 which draws air through any type of inlet device which may include a silencer and/or filter. This charge is drawn by the negative pressure created in the crankcase chamber 22 by the reciprocating motion of the piston 16. The construction of the piston 16, connecting rod 18, crankshaft 21 and crankcase chamber 22, as noted in the aforenoted incorporated Patent, is such that they define an enclosed volume inside crankcase chamber 22 into which the air/fuel charge is drawn by the upward motion of piston 16.

Referring now in more detail to the charge forming system 27, the air inlet device 35 delivers the inducted atmospheric air to a charge former 36, namely a carburetor of a conventional type such as the illustrated piston type air valve carburetor 36. The carburetor 36 unlike conventional carburetors is without any manually operated throttle valve or other flow controlling mechanism.

The carburetor 35 mixes fuel in a known manner with the inducted air and delivers it to an intake pipe or manifold 37. The intake manifold in turn delivers the fuel air mixture to an inlet chamber 38 formed on the lower side of the cylinder block 13 and crankcase member 23. This chamber 38 is closed by a cover plate 39. The inlet chamber 38 communicates with the crankcase chamber 22 to which it supplies the uncompressed air/fuel mixture through an intake port 41. As noted in the aforenoted Patent, the intake port 41 is opened and closed by the connecting rod 18 during its movement.

As the piston 16, connecting rod 18 and crankshaft 21 continue their movement, the inducted charge will continue to be drawn into the crankcase chamber 22 until the connecting rod 18 again closes the intake port 41. Thereafter the inducted charge will be compressed in the closed chamber into which the crankcase chamber 22 is formed on one side of the connecting rod 18. This compressed charge is then delivered to a plenum chamber 42 in a manner to be described shortly.

The plenum chamber 42 is formed by a housing element 43 that sealingly engages crankcase chamber 22 on its upper side, opposite the intake port 41 to the crankcase chamber 22. The plenum chamber 42 receives a supply of compressed air/fuel mixture from the crankcase chamber 22 through a reed valve 44. The reed valve 44 controls the flow through an opening 45 formed in an upper wall of the crankcase member 22 and permits the charge only to exit.

A pressure air conduit 46 delivers the compressed fuel air charge from the plenum chamber 42 to the cylinder head intake passage 26. Because the plenum chamber 42 can be quite large due to the remote positioning of the carburetor 35, the pressure delivered to the intake passage 26 will be relatively uniform. Because of the remote positioning of the carburetor 35 from the intake passage 26 and the presence of the large plenum chamber 42 there would be a loss of effective engine braking on decelerations if a conventional carburetor throttle valve arrangement were used.

Therefore and in accordance with one feature of the invention, a manually operated throttle valve assembly 47 is positioned downstream of plenum chamber 42. This throttle valve assembly 47 includes a throttle body 48 in which a butterfly type throttle valve 49 is positioned. The throttle valve 49 is operated by a throttle linkage 51 in a known manner by a remote controller. As noted, this layout is advantageous in that it eliminates several problems associated with the employment of a conventional single assembly charge former and throttle mechanism.

A conventional assembly positioned upstream of the plenum chamber 42 will adversely impact engine braking due to the fact that the unthrottled and compressed charge present in the plenum chamber 42 at the time of the throttle's closing for engine deceleration will induce a lag in the engine's response since this larger than now desired charge will tend to inhibit engine deceleration. The same conventional assembly positioned downstream of the plenum chamber 42 will adversely effect engine efficiency since the fuel would no longer be drawn into the engine crankcase 13 where it would effectively cool the bottom end of the engine. In addition, it is less likely that the air/fuel mixture delivered to the engine 11 for combustion will be fully vaporized since it no longer first enters the crankcase chamber 22 as before, where it would be readily vaporized by the motion of the piston 16.

With the embodiment described as above, however, no engine lag upon initiation of deceleration is encountered since the positioning of the throttle valve assembly 47 downstream of the plenum chamber 42 allows throttle valve 49 to immediately limit the quantity of the air/fuel charge entering combustion chamber 25 from the plenum chamber 42. The engine efficiency will also remain higher since the air/fuel mixture enters the engine upstream of the plenum 42, there to cool the engine's bottom end and also to be fully vaporized by the motion of piston 16.

The lubrication system for the crank chamber supercharged engine 11 will now be described. A conventional four cycle lubrication system is inappropriate for this type of engine as one of the requirements for a four stroke crankcase compression type engine is that the crankcase chamber 22 must be of minimum possible volume in order to obtain effective air/fuel charge compression and also because all of the intake charge passes through the crankcase chamber 22.

This is incompatible with the standard four cycle practice of utilizing the crankcase chamber 22 as the oil storage reservoir for the engine 11. However the valve train including the valves 28 and 31, the rocker arms 32 and 33, the cam shaft 34 and their bearings and guides require adequate lubrication. Therefore the engine 11 utilizes a lubricating system as described in more detail in my copending application entitled "Lubrication Device For Crank Chamber Supercharged Engine, "Ser. No. 08/563,971, Filed Nov. 29, 1995, and assigned to the assignee hereof (Attorney Docket No. YAMAH3.187A). This system utilizes two oil delivery systems: one of which supplies four cycle oil to the various components of the cylinder head 24 and timing case and a second which supplies two cycle oil to the various components of the cylinder block 13.

Figure 2:
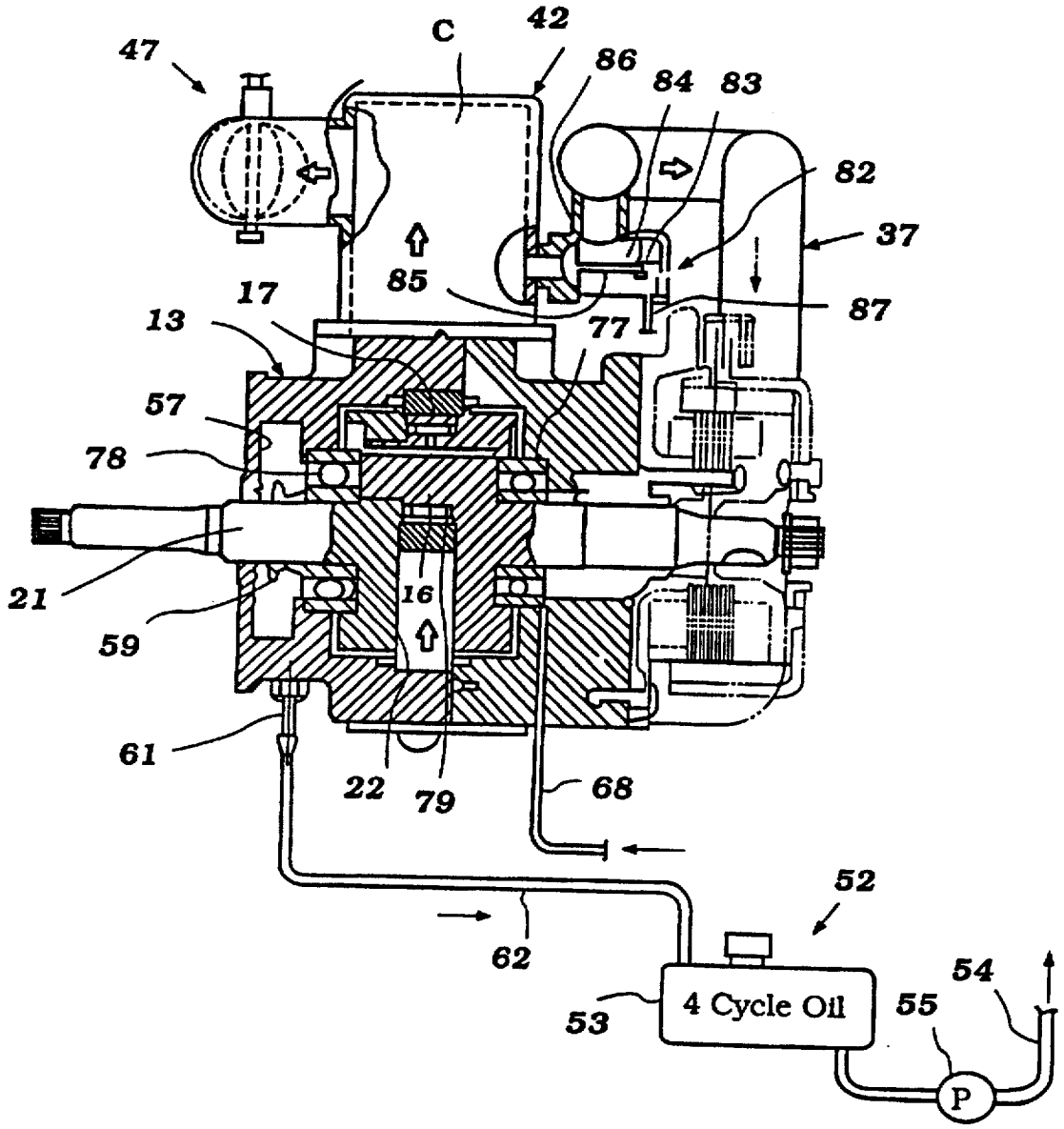
FIG. 2 is an enlarged cross-sectional view taken along the line 2—2 of FIG. 1.
Figure 3:
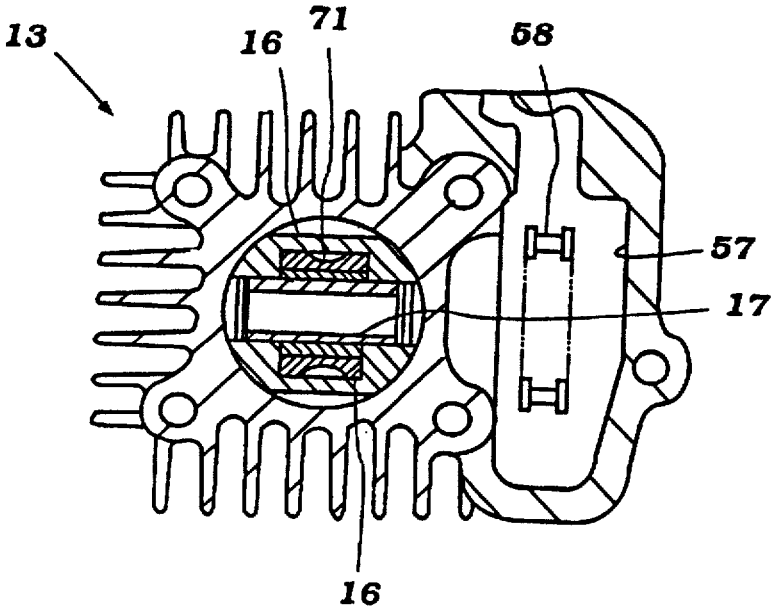
FIG. 3 is a cross-sectional view taken along the line 3—3 of FIG. 1 and shows the connection of the piston to the connecting rod.

Referring to the four cycle oil delivery system, this is best shown in FIGS. 1 and 2 and is identified generally by the reference numeral 52. Oil for this system is supplied from a four cycle oil tank 53 which contains the type of oil utilized normally with four cycle engines. This oil is supplied to the camshaft 34 at its main bearing (not shown) through conduit 54 in which is positioned an oil pump 55. The pump 55 is driven in any suitable manner. The camshaft 34 is drilled to provide a main oil gallery. Oil is delivered into camshaft 34 through a cross drilled camshaft oil inlet 56. Oil is delivered from the main gallery to the camshaft bearings (not shown) and rocker arm assemblies 32 and 33 respectively though oil feed holes drilled in the camshaft 34. Thus it is readily apparent that all of the components of the valve actuating mechanism are effectively lubricated by the four cycle oil which subsequently collects along a lubricating return path (not shown).

This return path routs the oil to a timing case 57 where it lubricates the components of the camshaft timing drive mechanism such as a chain 58 and the camshaft sprocket (not shown) and the crankshaft sprocket 59 before draining out of timing case 57 at one end of the crankshaft 21 through exit nipple 61. The exit nipple 61 supplies a four cycle oil return conduit 62 which, in turn, returns to the four cycle oil reservoir 53.

Referring now to the two cycle oil delivery system, indicated generally by the reference numeral 63, also shown primarily in FIGS. 1 and 2, it includes a two cycle oil tank 64. The oil tank 64 holds a supply of oil of the type normally used for two cycle engine lubrication. An oil pump 65 is driven in a known manner and pumps two cycle oil from the two cycle oil tank 64 through a conduit 66 to the ends of the engine block assembly 13, as seen on FIG. 1, via branch conduits 67 and 68 respectively.

Figure 4:
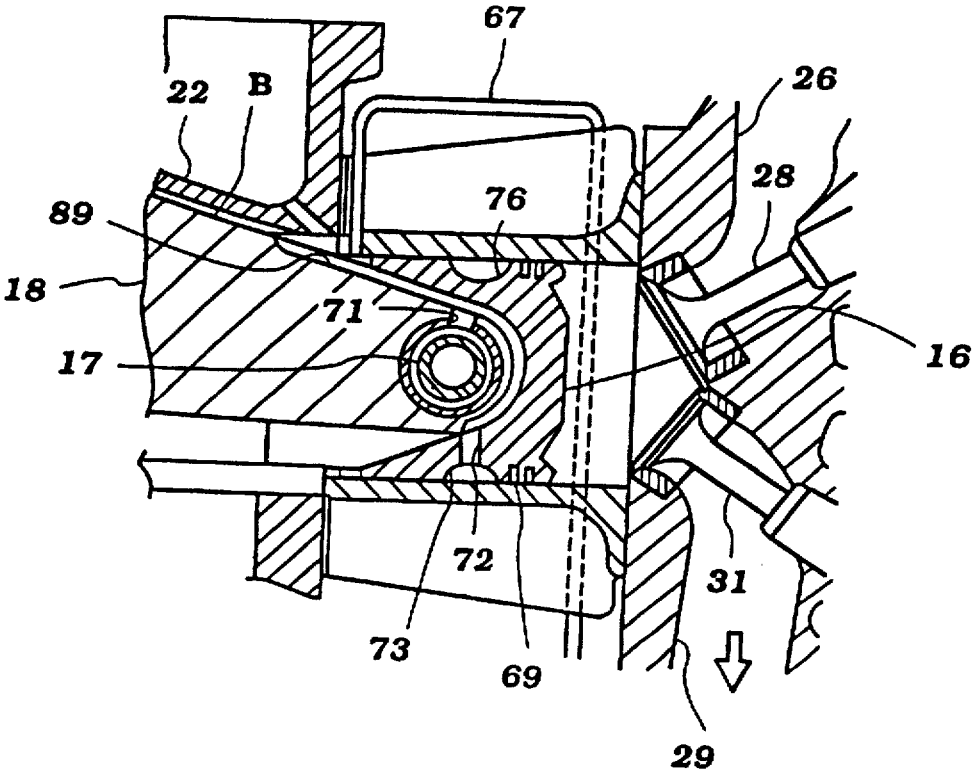
FIG. 4 is an enlarged cross-sectional view taken along a plane perpendicular to the plane of FIG. 3 and also showing the piston, connecting rod connection and the lubricating arrangement therefor.

Conduit 67 supplies oil to the cylinder bore 15 at a location that is exposed to the crankcase chamber 22 when the piston 16 is approaching top dead center. This oil is fed into groove 69 (see also FIG. 4)cut along the exterior side of the connecting rod 18. When conduit 67 is thus exposed, the connecting rod 18 is positioned as shown in FIGS. 1 and 4. The lubricant will collect in the groove and as the piston 16 reverses direction and moves toward bottom dead center the oil will be pumped along groove 69 to lubricate the piston's lower surface as well as the upper end of the connecting rod 18. This action will also cause the oil to enter the piston pin assembly 17 through inlet slot 71, there to lubricate the surface of piston pin 17.

The connecting rod groove 69 extends around the upper end of the connecting rod 18 to a point where it is then routed through a piston oil slot 72 to a recess 73 formed on the lower portion of the piston 16 and finally on to the cylinder wall. Any remaining oil will drain to the crankcase chamber 22 and specifically to the inlet chamber 38. From there the oil will drain through a two cycle drain nipple 74. The oil drains into a two cycle oil return conduit 75 which, in turn, connects at its lower end to the two cycle oil reservoir 64.

As the piston 16 reciprocates downwards upon initiation of an engine inlet or power stroke the supply of two cycle oil to the crankcase chamber 22 from conduit 67 will be restricted to lubricate only the skirt of the piston 16. However, continued downward motion of piston 16 exposes the outlet for conduit 67 to an upper side piston recess 76 in which the oil will collect and lubricate the outer circumferential surface of piston 16 until it too is collected at the inlet nipple of the two cycle oil return conduit 74.

Conduit 68 supplies two cycle lubricating oil to the engine's big end. As can be best seen in FIG. 2 oil is delivered by the conduit 68 to one main bearing 77 of the crankshaft 21. The crankshaft 21 is cross drilled enabling the oil supplied at crankshaft bearing 77 to not only lubricate this bearing 77 but also to circulate through crankshaft 21 to its other main bearing 78 which journals crankshaft 21 to crankcase chamber 22. Through these cross drillings lubricant is also delivered to a bearing 79 that journals the connecting rod 18 to the crank throw 19. Thus, all of the crankshaft bearings in crankcase chamber 22 are adequately lubricated by the two cycle oil before it collects in the air inlet 38 of the crankcase 22 for delivery to the two cycle oil return conduit 75 which, in turn, connects at its lower end to two cycle oil reservoir 64.

Under some circumstances it may be desirable to control the maximum pressure of the charge delivered to the combustion chamber 25, as would be the case during engine deceleration. A venting or pressure relief mechanism is disposed in the charge forming system 27 to accomplish this. As can be best seen in FIG. 2 an air vent hose 81 extends between the plenum chamber 42 and the air inlet pipe 37. The flow through this hose 81 is controlled by a spring loaded poppet type valve 82. The valve spring 83 engages a diaphragm 84 to which a valve element 85 is fixed. The spring 83 has sufficient preload to cause the valve element 85 to sealingly engage air vent inlet hose 81 until such time as when the pressure of the charge in the plenum chamber 42 is sufficiently high to displace the valve 82 rearward, thereby allowing the pressurized charge to vent back to the atmospheric air inlet 37 through a vent air outlet hose 86.

If desired the chamber in which the spring 83 is located may also be connected by a conduit 87 to the intake manifold 46 downstream of the throttle valve 49. When this is done, under extreme decelerations the high intake manifold vacuum will overcome the bias of the spring 83 and cause the valve element 85 to open and relieve the high pressure in the plenum chamber 42.

Figure 5:
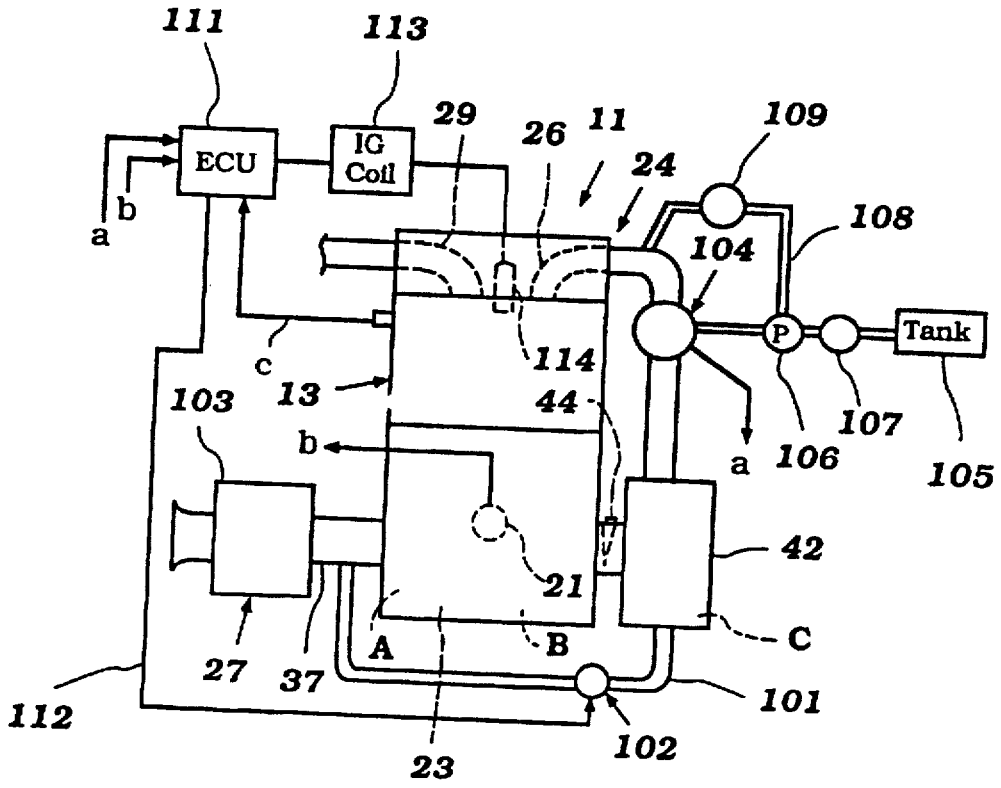
FIG. 5 is a partially schematic view showing a further embodiment of the invention.

FIG. 5 shows in more schematic form an engine constructed in accordance with another embodiment of the invention. In this invention, the bypass passage way provided for by the conduit 81 and the pressure responsive valve 82 is replaced by a bypass conduit 101 in which an electrically operated valve 102 is positioned. In addition, in this embodiment, the induction system air inlet device is shown schematically at 103. As previously noted, this air inlet device may include a silencing system and/or a filter (not shown).

In this embodiment, the carburetor 36 is replaced by a small simple variable venturi carburetor, indicated generally by the reference numeral 104 that is positioned between the plenum chamber 42 and the cylinder head intake passage 26. It should be noted that in this figure components which are the same as those of the previously described embodiment have been identified by the same reference numerals and will not be described again, except insofar as to understand the construction and operation of this embodiment.

The carburetor 104 is designed so as to provide only the low range fuel requirements for the engine, however, its throttle valve controls the total air flow to the engine. The carburetor 104 is supplied with fuel from a fuel tank indicated schematically at 105 under pressure from a pump 106 through a conduit in which a filter 107 is positioned.

The main fuel requirements for the engine are supplied by a fuel injector line 108 in which a fuel controlling valve 109 is positioned. This passage 108 sprays fuel through injector, under mid and high speed and high load conditions that may be a manifold type or port type injector.

An ECU, indicated generally by the reference numeral 111, receives a signal c from a knock sensor, a signal a indicative of the position of the throttle valve of the carburetor 104 and other signals, such as an engine speed signal indicated at b. The ECU control 111 controls the valve 102 through an electrical conductor 112 and also controls the ignition circuit, indicated at 113. This controls the firing of the spark plug 114. The spark plug was not illustrated in the previous embodiment but is utilized for firing the charge in the combustion chamber.

By employing the ECU 111, it is possible to obtain maximum pressure and performance while avoiding knocking. If knocking is detected by the sensor signal c, the valve 102 is opened to lower the boost pressure. Also, ignition timing can be retarded for this same purpose. However, it is better to maintain optimum engine performance by maintaining the ignition firing as required while, at the same time, reducing the actual pressure.

This embodiment has the advantage of providing better performance under transient conditions since the charge forming system is closer to the combustion chamber. By utilizing a small primary carburetor and a fuel injection, the size of the plenum chamber 42 still may be maintained large. In addition, engine braking performance will be improved. If desired, the pressure in the plenum chamber 42 may also be relieved under braking conditions to achieve this goal.

Figure 6:
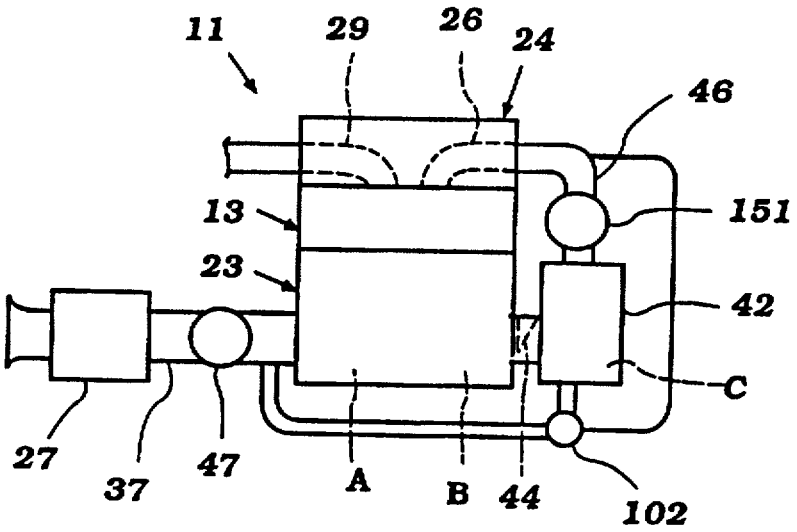
FIG. 6 is a view, in part similar to FIG. 5, and shows yet another embodiment of the invention.
Figure 7:
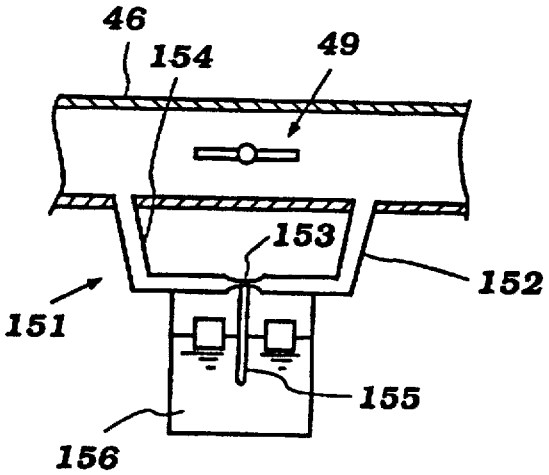
FIG. 7 is an enlarged cross-sectional view showing the low speed charge former for this embodiment in cross-section and its relationship to the throttle valve.

FIGS. 6 and 7 show schematically another embodiment of the invention. This embodiment is more like the embodiment of FIGS. 1–4. However, in order to improve performance under transient conditions, a simple carburetor 151 is provided in a bypass air flow line 152 that bypasses the main throttle valve 49 in the main air passage 46. The simple carburetor 152 has a venturi section 153 that is fed by a small bypass air passage 154. A simple main metering jet 155 supplies fuel from a fuel bowl 156 to the air flowing through the passage 154. Hence, as air flow changes due to transient conditions, adequate fuel will be provided during the time period before the main supply from the main carburetor 36 reaches the intake passage.

It should be readily apparent form the foregoing description that the described embodiments of the invention provide a very effective induction system for a crankcase compression internal combustion engine that achieves good throttle response under both braking and acceleration, permits a compact construction, and also provides an arrangement wherein the maximum pressure in the charge delivered to the combustion chambers can be controlled if desired of course, the foregoing description is that of preferred embodiments of the invention, and various changes and modifications may be made without departing from the spirit and scope of the invention, as defined by the appended claims.

What is claimed is:

1. An internal combustion engine comprised of a cylinder block, cylinder head assembly defining a cylinder bore, a piston reciprocating in said cylinder bore and forming a combustion chamber at one end of said cylinder bore, a crankcase chamber formed at the other end of said cylinder bore and containing a rotatably journaled crankshaft, a connecting rod operatively connecting said piston to said crankshaft for driving said crankshaft upon reciprocation of said piston, said crankshaft, said connecting rod, said piston and said crankcase chamber being formed so that said crankcase chamber functions as a compressor as said piston reciprocates in said cylinder bore, said crankcase chamber forming a portion of an induction system for delivering atmospheric air under pressure to said combustion chamber, said induction system including, in addition to said combustion chamber, an atmospheric air inlet for supplying atmospheric air to said crankcase chamber and a pressure air conduit for communicating compressed air from said crankcase chamber to said combustion chamber, a manually operated throttle valve in said induction system for controlling the flow therethrough, and a selectively controllable bypass conduit extending between said atmospheric air inlet and said pressure air conduit for permitting flow therebetween without passing through said crankcase chamber.

2. An internal combustion engine as set forth in claim 1, further including a charge former in the atmospheric air inlet for supplying at least a portion of a fuel charge to the engine.

3. An internal combustion engine as set forth in claim 2, further including a second charge former disposed in the pressure air conduit.

4. An internal combustion engine as set forth in claim 3, wherein the major portion of the fuel supplied during the major portion of the engine running conditions is supplied by the charge former in the atmospheric air inlet.

5. An internal combustion engine as set forth in claim 3, wherein the second charge former comprises a fixed venturi-type of carburetor.

6. An internal combustion engine as set forth in claim 5, wherein the second charge former supplies the fuel requirements for the engine at low load, low speed conditions.

7. An internal combustion engine as set forth in claim 6, wherein the major portion of the fuel supplied during the major portion of the engine running conditions is supplied by the charge former in the atmospheric air inlet.

8. An internal combustion engine as set forth in claim 1, further including a charge former in the pressure conduit.

9. An internal combustion engine as set forth in claim 8, wherein the charge former is provided in a branch passage in parallel flow relationship with a passage in which the throttle valve is positioned.

10. An internal combustion engine as set forth in claim 9, wherein there is provided a further charge former for supplying the major portion of the fuel requirements for the engine at mid-range and the high speeds.

11. An internal combustion engine as set forth in claim 10, wherein the further charge former is positioned downstream of the first charge former.

12. An internal combustion engine as set forth in claim 10, wherein the further charge former comprises a fuel injector.

13. An internal combustion engine as set forth in claim 12, wherein the fuel injector injects into the induction system downstream of the throttle valve.

14. An internal combustion engine as set forth in claim 1, wherein the bypass conduit is controlled for limiting the pressure in the pressure conduit.

15. An internal combustion engine as set forth in claim 1, wherein the bypass is controlled in response to induction system vacuum downstream of the throttle valve.

16. An internal combustion engine as set forth in claim 1, further including a plenum chamber disposed in the pressure air conduit.

17. An internal combustion engine as set forth in claim 16, wherein the bypass conduit is controlled for limiting the pressure in the pressure conduit.

18. An internal combustion engine as set forth in claim 16, further including a charge former in the atmospheric air inlet for supplying at least a portion of a fuel charge to the engine through the crankcase chamber.

19. An internal combustion engine as set forth in claim 18, further including a second charge former disposed in the pressure air conduit downstream of the plenum chamber.

20. An internal combustion engine as set forth in claim 19, wherein the major portion of the fuel supplied during the major portion of the engine running conditions is supplied by the charge former in the atmospheric air inlet.

21. An internal combustion engine as set forth in claim 19, wherein the second charge former comprises a fixed venturi-type of carburetor.

22. An internal combustion engine as set forth in claim 21, wherein the second charge former supplies the fuel requirements for the engine at low load, low speed conditions.

23. An internal combustion engine as set forth in claim 22, wherein the major portion of the fuel supplied during the major portion of the engine running conditions is supplied by the charge former in the atmospheric air inlet.

24. An internal combustion engine as set forth in claim 18, wherein the charge former is disposed in the pressure conduit, but independently of the throttle valve and downstream of the plenum chamber.

25. An internal combustion engine as set forth in claim 24, wherein the charge former is provided in a branch passage in parallel flow relationship with a passage in which the throttle valve is positioned.

26. An internal combustion engine as set forth in claim 25, wherein there is provided a further charge former for supplying the major portion of the fuel requirements for the engine at mid-range and the high speeds.

27. An internal combustion engine as set forth in claim 26, wherein the further charge former is positioned downstream of the first charge former.

28. An internal combustion engine as set forth in claim 26, wherein the further charge former comprises a fuel injector.

29. An internal combustion engine as set forth in claim 28, wherein the fuel injector injects into the induction system downstream of the throttle valve.

30. An internal combustion engine as set forth in claim 16, wherein the bypass is controlled in response to induction system vacuum downstream of the throttle valve.

* * * * *